US011247790B2

(12) United States Patent
Otxoa-Aizpurua Calvo et al.

(10) Patent No.: US 11,247,790 B2
(45) Date of Patent: Feb. 15, 2022

(54) PACKAGING METHOD AND APPARATUS

(71) Applicant: ULMA Packaging Technological Center, S. Coop., Oñati (ES)

(72) Inventors: Alberto Otxoa-Aizpurua Calvo, Oñati (ES); Oier Olalde Arregui, Oñati (ES); Eneko Izquierdo Ereño, Oñati (ES)

(73) Assignee: ULMA Packaging Technological Center, S. Coop., Oñati (ES)

( * ) Notice: Subject to any disclaimer, the term of this patent is extended or adjusted under 35 U.S.C. 154(b) by 239 days.

(21) Appl. No.: 16/513,998

(22) Filed: Jul. 17, 2019

(65) Prior Publication Data

US 2019/0337651 A1 Nov. 7, 2019

Related U.S. Application Data

(63) Continuation of application No. PCT/ES2018/070128, filed on Feb. 21, 2018.

(30) Foreign Application Priority Data

Feb. 27, 2017 (EP) ..... 17382096

(51) Int. Cl.
*B65B 9/20* (2012.01)
*B65B 51/30* (2006.01)
(Continued)

(52) U.S. Cl.
CPC ..... *B65B 9/2049* (2013.01); *B65B 9/213* (2013.01); *B65B 51/30* (2013.01); *B65B 51/303* (2013.01);
(Continued)

(58) Field of Classification Search
CPC ..... B65B 9/2049; B65B 9/2056; B65B 9/207; B65B 9/213; B65B 51/146; B65B 51/30;
(Continued)

(56) References Cited

U.S. PATENT DOCUMENTS 3,326,097 A * 6/1967 Lokey ..... B32B 37/1292 493/295
3,552,087 A * 1/1971 Schneider ..... B65B 9/213 53/451
(Continued)

FOREIGN PATENT DOCUMENTS

| | | |
|---|---|---|
| EP | 0269145 A1 | 6/1988 |
| EP | 3366594 A1 | 8/2018 |
| WO | 2018154164 A1 | 8/2018 |

OTHER PUBLICATIONS

International Search Report and Written Opinion in corresponding PCT Application No. PCT/ES2018/070128, dated Aug. 30, 2018, 9 pages.
(Continued)

*Primary Examiner* — Joshua G Kotis
(74) *Attorney, Agent, or Firm* — Edell, Shapiro & Finnan, LLC

(57) ABSTRACT

According to one embodiment a packaging method is provided in which a tube is supplied in a forward movement direction. The method includes a folding step in which the tube is acted on in a manner that is transverse to the forward movement direction, folding part of the tube in a folding direction, and a sealing and cutting step after which a tube closed at one end and a package closed and separated from the tube are obtained. During the folding step the tube is held transversely, and a tear is generated in the folding direction between the acted on and held parts of the tube. The tube is sealed on both sides of the tear and cut at the height of the tear. Packaging machines for carrying out the method are also disclosed. Suitable.

4 Claims, 8 Drawing Sheets

(51) Int. Cl.

| | |
|---|---|
| ***B65B 61/02*** | (2006.01) |
| ***B65B 61/12*** | (2006.01) |
| ***B65B 61/06*** | (2006.01) |
| ***B65B 9/213*** | (2012.01) |
| *B65B 9/207* | (2012.01) |
| *B65B 61/18* | (2006.01) |

(52) U.S. Cl.
CPC ..... *B65B 61/02* (2013.01); *B65B 61/06* (2013.01); *B65B 61/12* (2013.01); *B65B 9/207* (2013.01); *B65B 9/2028* (2013.01); *B65B 61/188* (2013.01)

(58) Field of Classification Search
CPC ..... B65B 51/303; B65B 61/06; B65B 61/12; B65B 61/02; B31B 2155/003; B31B 70/262; B31B 70/266
See application file for complete search history.

(56) References Cited

U.S. PATENT DOCUMENTS 4,129,976 A 12/1978 Grundler et al.
4,609,107 A * 9/1986 Martin ..... B26F 1/22 383/210
4,655,737 A * 4/1987 Benoit ..... B31B 70/00 493/194
5,284,002 A * 2/1994 Fowler ..... B29C 66/4312 53/412
5,505,040 A * 4/1996 Janssen ..... B65B 9/2042 53/451
5,570,569 A * 11/1996 Masuda ..... B65B 7/06 53/133.2
6,860,084 B2 * 3/2005 Knoerzer ..... B65D 33/2591 53/133.4
7,174,697 B2 * 2/2007 Hada ..... B65B 9/067 53/141
8,776,484 B2 * 7/2014 Kondo ..... B65B 9/2028 53/551
8,876,383 B2 * 11/2014 Doll ..... B65B 61/18 383/209
2007/0081745 A1 * 4/2007 Tetenborg ..... B65B 61/02 383/207
2007/0084142 A1 4/2007 Matthews
2010/0037567 A1 * 2/2010 Tsuruta ..... B29C 66/1122 53/551
2013/0059709 A1 * 3/2013 Miyamoto ..... B29C 66/1122 493/186
2016/0272349 A1 9/2016 Michels

OTHER PUBLICATIONS

Extended European Search Report in corresponding EP Application No. 17382096.0, dated Sep. 7, 2017, 5 pages.

* cited by examiner

PACKAGING METHOD AND APPARATUS

CROSS-REFERENCE TO RELATED APPLICATIONS

This application relates to and claims the benefit and priority to International Application No. PCT/ES2018/070128, filed Feb. 21, 2018, which relates to and claims the benefit and priority to European Application No. EP17382096.0, filed Feb. 27, 2017.

TECHNICAL FIELD

The present invention relates to packaging methods and machines used for packaging products.

BACKGROUND

Some packages in which products are packaged are generated from films, said films being formed into a tubular shape, acting on the formed tube of film material as appropriate for generating the package. When the film is formed into a tubular shape, longitudinal sealing of the longitudinal ends of the film is further required to thereby close the tube longitudinally. Subsequently, or simultaneously, seals and transverse cuts are made in the tube to obtain packages closed at both ends. The product to be packaged is first introduced in the tube. Two closures are usually obtained in each sealing and transverse cutting operation: a first closure for the tube on one side of the cut, which will be a first closed end of a package generated after it; and a second closure on the other side of the cut. The second closure closes the other end of a package closed by the first closure in the preceding operation.

Some packages, such as DOYPACK® pouches or flat bottom packages, for example, comprise at least one fold and require additional operations with respect to those discussed in the preceding paragraph for generating the folds.

Patent document US20160272349A1 discloses a vertical packaging machine for packaging products in which the package is generated from a continuous film. The film is formed into a tubular shape and sealed longitudinally for generating a tube of film material. The tube is driven in a vertical forward movement direction, and two reinforcements are generated on each side of the tube during said driving. To that end, the machine comprises actuation means on each side of the tube folding said tube inwardly from opposite sides thereof as said tube moves in the forward movement direction, a longitudinal reinforcement being generated on each side of each fold. With the reinforcements already made, cutting and transverse sealing with respect to the forward movement direction are made in the tube in a given manner and by means of a K-shaped tool further making an additional fold in the area of the tube being cut and sealed, said additional fold being used to reinforce the bottom of the resulting package. A piece of film is previously removed from each side of the tube, and said piece is disposed of to make the subsequent operation of the K-shaped tool easier.

SUMMARY

A first aspect relates to a packaging method for a packaging machine, in which a tube of film material generated from a continuous film is supplied in a forward movement direction. The method comprises at least one folding step in which said tube is acted on by contact, in a manner that is transverse to the forward movement direction, to laterally fold part of the tube inwardly in a folding direction transverse to the forward movement direction, and a sealing and cutting step in which a tube at one end closed is obtained upstream in the forward movement direction, and a package closed at both ends and separated from the tube is obtained downstream in said forward movement direction.

In the method, at least during the folding step, the tube is furthermore held in a manner that is transverse to the forward movement direction on one side of the part of the tube to be folded with respect to the forward movement direction, and during the folding of the tube a partial lateral tear is generated in the folding direction, between the part of the tube that is contacted in order to be folded and the held part of the tube, the tube being sealed on both sides of the partial lateral tear and said tube being cut at the height of the partial lateral tear during the sealing and cutting step, the folded part being located in the package and/or in the closed tube, depending on how and on which side the tube is held transversely with respect to the forward movement direction.

As a result of the tension to which the tube is subjected by being held, this tear allows the part of the tube comprised between said tear and the held part to return to its previous shape before folding, if it had been affected by the folding, or to maintain its shape without being affected by the folding. As a result of the tear and shape recovery, furthermore, the sealing corresponding to one of the ends of the package (or at least part of it) is done on a crease-free area of the tube, for example, obtaining post-sealing straight weld similar to that of pouch-type packages, without any folds or creases in said area, and the sealing of the opposite end of the contiguous package, which is sealed simultaneously in the same step, is done on the folded area of the tube, one end of said contiguous package that is similar to that of Doy-Pack or flat bottom type packages being obtained post-sealing, for example. This allows generating independent packages with one end being different from the contiguous end, maintaining the same orientation (the flat bottom, for example, downstream in the forward movement direction), without having to design a more complex machine, making the machine implementing said method more versatile, since it allows making packages of this type (with a fold on at least one side of an end of the package, being smooth and fold-less on the same side of the other end of the package).

Due to folding, the packages obtained from the proposed method can therefore comprise a fold on at least one side of one of the ends, and a smooth, fold-less sealing on the same side of the other end. Flat bottom type packages, among others, can thereby be manufactured with the method without having to make additional folds, as occurs in the prior art. The amount of film material to be used for a package having the same features is therefore subject to savings.

Furthermore, for one and the same amount of film material, the packages obtained from the proposed method comprise a larger storage volume for the product to be packaged than DOYPACK® pouches or flat bottom type packages obtained in the prior art comprise because it allows not providing folds at one of its ends, whereas the contiguous end can comprise a weld with fold similar to that of DOYPACK® pouches or flat bottom type packs. The advantages of pouch-type packages, with a large storage volume, and the advantages of the DOYPACK® pouches or flat bottom type packages are thereby combined with a better product presentation.

Additionally, the proposed method prevents generating waste (pieces of film material) that requires specific subsequent processing to prevent them from accidentally being introduced into the package, for example, and/or to prevent them from affecting or interfering with the parts or processes of the packaging machine.

Furthermore, all this is achieved with tools and/or devices that may be conventional, without having to incorporate specifically-designed tools and/or devices that could make the machine in which the method is implemented and the control and maintenance thereof, more complicated.

A second aspect relates to a packaging machine. The packaging machine comprises:

- a driving device for supplying a tube of film material in a forward movement direction,
- an actuation device for acting by contact on said tube, in a manner that is transverse to the forward movement direction, to laterally fold part of the tube inwardly in a folding direction transverse to the forward movement direction,
- a sealing and cutting device for sealing and cutting the tube in a manner that is transverse to the forward movement direction, a tube closed at one end being obtained upstream in the forward movement direction, and a package closed at both ends and separated from the tube being obtained downstream in said forward movement direction, and
- a control device.

The packaging machine further comprises a holding device for holding the tube in a manner that is transverse to the forward movement direction. The actuation device is suitable and configured for generating, by acting on the tube, and in addition to folding, a tear in a part of the tube located between the actuation device and the holding device, extending transverse to the forward movement direction.

The control device is at least configured for causing the holding device to hold the tube in a manner that is transverse to the forward movement direction, at least during the action of the actuation device on said tube, and for causing the sealing and cutting device to act on the tube for obtaining the package once the tube has been acted on with the actuation device and the tear has been generated, the folded part being located in the package and/or in the closed tube.

The same advantages as those discussed with respect to the packaging method are thereby achieved. Additionally, the machine allows incorporating easy-open or reclosable elements, such as a zipper-type element, for example, conventionally at one of the ends of the package, without incorporating additional elements in the machine, and without having to change the orientation of the packages in each packaging cycle.

These and other advantages and features will become evident in view of the drawings and detailed description.

DETAILED DESCRIPTION

Figure 1:
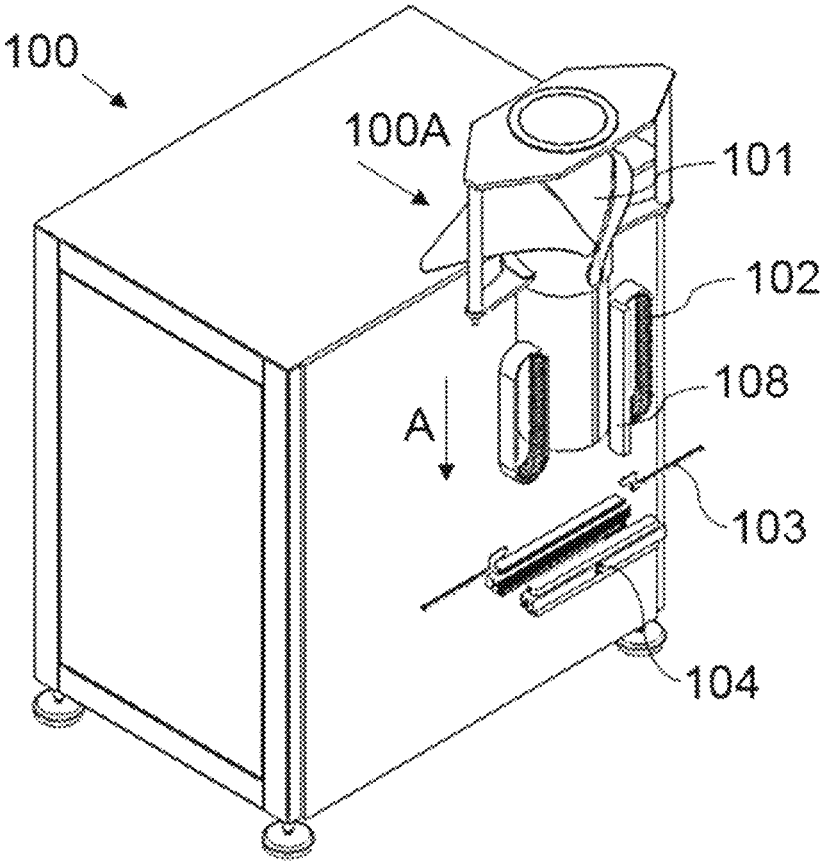
FIG. 1 schematically shows an embodiment of a packaging machine in which only some elements and/or devices of the machine are depicted.

A first aspect relates to a packaging method for a packaging machine 100, such as the one shown partially and by way of example in FIG. 1, in which a tube 10 of film material generated from a continuous film is supplied in a forward movement direction A, and packages E are generated from said tube 10. FIGS. 2 to 6 depict, by way of example and in a schematic manner, different steps performed while carrying out a preferred embodiment of the method.

The method can comprise a forming step in which it generates the tube 10 from the corresponding film, by welding for example the longitudinal sides of the film to one another. The method further comprises at least the following steps:

- a folding step in which said tube 10 is acted on by contact, in a manner that is transverse to the forward movement direction A, to laterally fold part of the tube 10 inwardly in a folding direction T transverse to the forward movement direction A, and
- a subsequent sealing and cutting step in which a tube 10 closed at one end is obtained upstream in the forward movement direction, and a package E closed at both ends and separated from the tube 10 is obtained downstream in said forward movement direction A.

In the method, at least during the folding step, the tube 10 is furthermore held by a first holding device 106 in a manner that is transverse to the forward movement direction A, preferably on one side of the part of the tube 10 to be folded with respect to the forward movement direction A, and during the folding of the tube 10 a partial lateral tear R is generated in the folding direction T between the folded part of the tube 10 and the held part of the tube 10, the tube 10 being sealed on both sides of the partial lateral tear R and said tube 10 being cut at the height of the partial lateral tear R during the subsequent sealing and cutting step, the folded part being located in the package E and/or in the closed tube 10, depending on how and on which side the tube 10 is held transversely with respect to the forward movement direction A. The tear R that is generated is partial, such that it does not separate the tube 10 into two parts. The package E thereby obtained therefore comprises a fold P2 and/or P1 on at least one side of one of the ends, and a smooth, fold-less sealing on the same side of the other end.

When the tube 10 is held in a manner that is transverse to the forward movement direction A, the two opposite faces of the tube in the held area contact one another, which also affects the vicinity of the held area, which tend to move closer to one another. Once the tube 10 is held, in the held area (and in the vicinity), it is converted into two superimposed films, acting on said superimposed films from one side thereof in the folding step, in the folding direction T, and the tear R being generated from one side of said superimposed films (hence the name "lateral" tear). This tear R allows the part of the tube 10 between the tear R and the holding to "become independent" of the folding effected on the tube 10, such that said part is either not affected by the folding or else it recovers its previous shape before folding, if it had lost said shape as a result of said folding. This entails having a smooth, fold-less part of the tube 10, resulting in a clean subsequent sealing in that area of the tube 10. At the same time, the tension generated in the tube 10 during the folding step in the vicinity of the tear R makes it possible to generate a uniform and crease-free fold.

The sealing and cutting step is after the folding step, such that it starts after starting the folding step, but it can commence without said folding step having ended or once said folding step has ended. The sealing and cutting step, in any case, commences once the part of the tube 10 comprised between the tear R and the held part returns to its previous shape before folding, if it had been affected by the folding, thereby assuring the sealing in a smooth, fold-less part, of the tube 10.

The tube 10 comprises a line of weakness 5, and part of the tube 10 close to said line of weakness 5 and on one side of said line of weakness 5 is acted on by contact in the folding step with respect to the forward movement direction A, the partial lateral tear R being generated along said line of weakness 5 as a result of said action. Preferably, the part of the tube 10 to be folded is positioned opposite the device in charge of performing said action on said part of the tube 10. The line of weakness 5 can be a transverse, discontinuous linear cut, for example, and by acting on the tube 10, the discontinuous linear cut becomes a continuous linear cut.

In some embodiments of the method, the film from which the tube 10 is formed comprises a previously made line of weakness, and in the folding step part of the tube 10 located close to and on one side of the line of weakness is acted on by contact in the forward movement direction A, in order to cause said tear R along part of the line of weakness.

In other embodiments of the method, the tube 10 can comprise two lines of weakness, which are preferably aligned with one another, one on each side of the tube 10, or a single line of weakness on only one side of the tube 10.

In some embodiments, such as in the preferred embodiment, the method comprises a preparation step prior to the folding step in which a line of weakness 5 is generated in the tube 10, or in the film from which the tube 10 is generated, transverse to the forward movement direction A. The folding step is subsequently performed in a part of the tube 10 close to and on one side of the line of weakness 5 with respect to the forward movement direction A, such that as a result of the line of weakness 5, said action causes the partial lateral tear R of the tube 10 (in the part comprising the line of weakness 5). The line of weakness 5 can be a transverse discontinuous linear cut, for example, and with the action on the tube 10 the discontinuous linear cut (line of weakness 5) becomes a continuous linear cut (tear R). In some of these embodiments, the line of weakness 5 is made in the film 1 itself before the tube 10 is formed, and in other embodiments the line of weakness 5 is generated in the tube 10 that is already formed.

Figure 2:
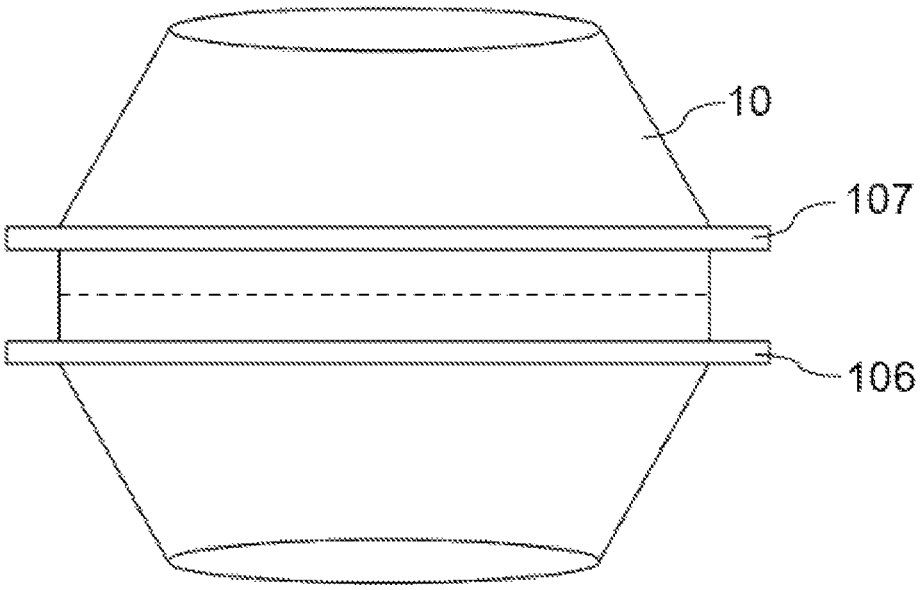
FIG. 2 schematically depicts a step in which a tube is held transversely by two holding devices of the machine of FIG. 1.
Figure 3:
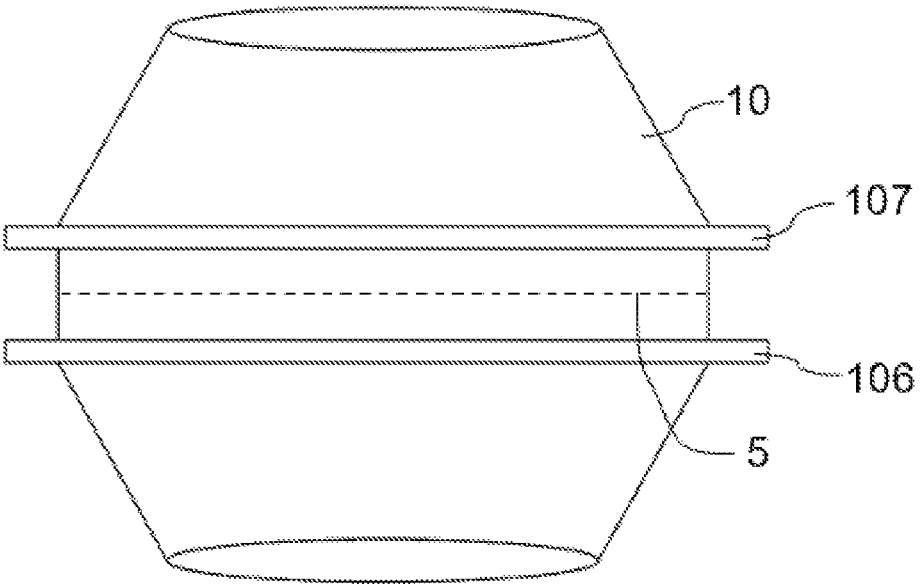
FIG. 3 schematically depicts a step in which the tube is held transversely by two holding devices of the machine of FIG. 1, once a line of weakness is generated in the tube.
Figure 4:
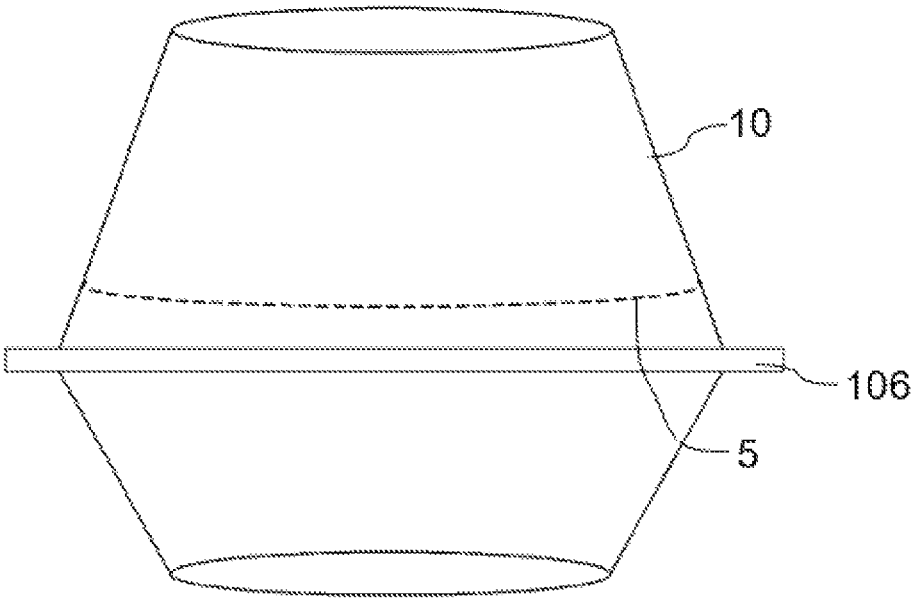
FIG. 4 schematically depicts a step in which the tube is held transversely by a single holding device of the machine of FIG. 1, once the line of weakness is generated.

According to one embodiment, the line of weakness 5 is generated in the tube 10 and before doing this, in addition to the mentioned holding of the tube 10 during the folding step (first holding), the tube 10 is additionally held, by a second holding device 107, at a part that is separated a given distance in the forward movement direction A from said first holding, as depicted in FIG. 2, and the line of weakness 5 is generated between both two held parts of the tube 10 and while both holdings are maintained (FIG. 3, depicting both holds and the already generated line of weakness 5). Correct generation of the line of weakness 5 is thereby assured, since as the tube 10 is generated, it is held taut and does not move with respect to the device in charge of making the line of weakness 5. Once the line of weakness 5 is generated, the additionally held part of the tube 10 is released, see FIG. 4, and the folding step is performed maintaining only the first holding.

According to one embodiment, the line of weakness 5 is generated by means of a device that is arranged in a first position for generating said line of weakness 5 and in a second position for generating the transverse cut of the tube 10.

Figure 5:
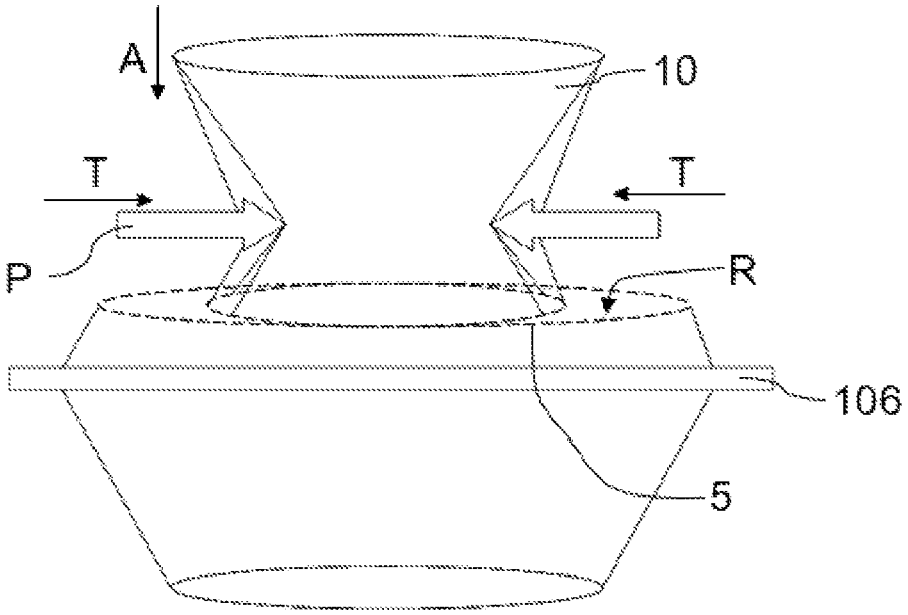
FIG. 5 schematically shows a step in which the tube is held transversely by a single holding device of the machine of FIG. 1, in which action on each side of the tube and the generation of a partial lateral tear in the tube are further depicted.
Figure 12A:
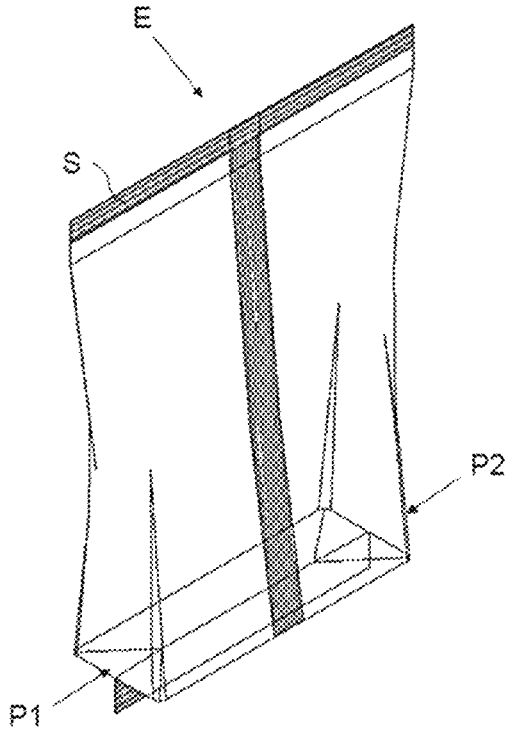
FIGS. 12A, 12B and 12C show three possible packages obtained from the method of the invention, and/or with the machine of the invention.
Figure 12B:
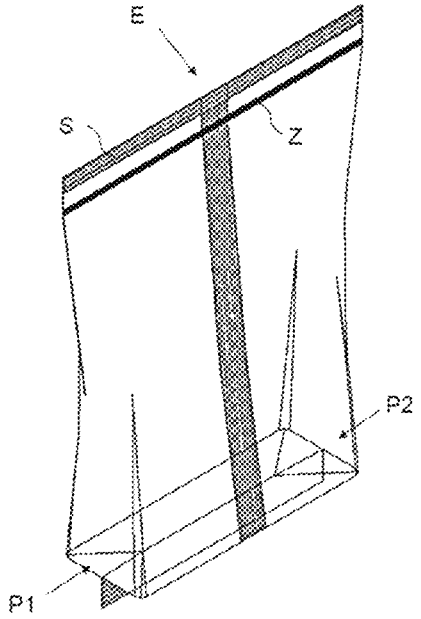

In the folding step, only part of the tube 10, or two opposite parts of the tube 10, can be acted on simultaneously by contact (a resulting package E is shown in FIGS. 12A and 12B, with a fold P1 and P2 on each side of one end and a smooth, fold-less and transverse weld S at the other end). This latter case would therefore require two lines of weakness 5, one for each action, or a line of weakness 5 which could be associated with both actions, such as one that covers the entire width of the tube 10 as depicted in FIG. 5, for example, where the actions are depicted with an arrow and with reference P. In this case, the folded part would therefore be located in the package E.

Figure 12C:
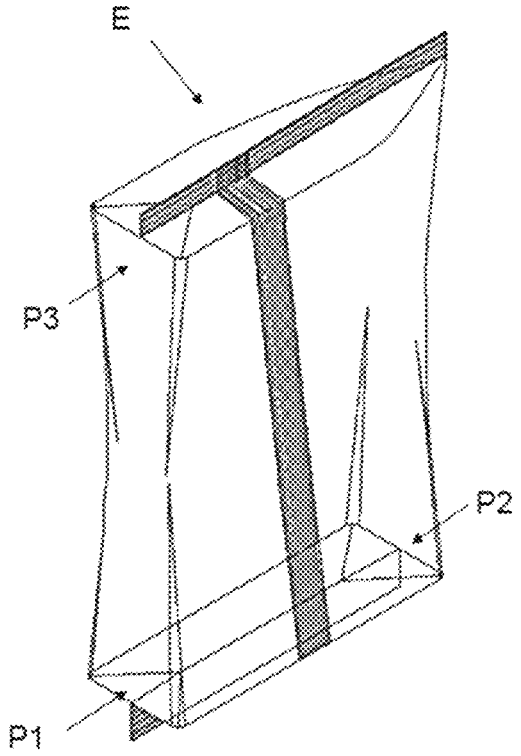

In the folding step, three parts of the tube 10 can also be acted on simultaneously by contact: two opposite parts and another part spaced from one of the two aforementioned parts in the forward movement direction A. In this case, a single line of weakness 5 is generated close to and on the side of one of the parts acted on in the forward movement direction A, and the first holding does not cover the entire transverse width of the tube 10, but rather is done only on one side in the forward movement direction A of the part acted on associated with the line of weakness 5, resulting in a package E with three folds P1, P2 and P3, as shown by way of example in FIG. 12C. The package E thereby obtained therefore comprises, due to the folding, a fold P2 on at least one side of one of the ends, and a smooth, fold-less sealing on the same side of the other end. In this case, the folded part is located both in the package E (folds P1 and P2) and in the closed tube 10 (folding P3).

In any of the cases, a zipper-type closure Z can be added in the tube 10, resulting in a package E with that type of closure as shown by way of example in FIG. 12B. This closure can be added with conventional tools or devices, and the method allows including it without having to modify it (beyond incorporating the step of adhering this type of closure in the tube).

According to one embodiment of the method, once a tube 10 of film material has already been formed (and without adding an adhesion step for adhering the zipper-type closure), is briefly described below in chronological order:

The tube 10 is held transversely in two parts spaced from one another in the forward movement direction A.

The line of weakness is generated (preparation step).

One of the two holdings is released.

The tube 10 is acted on by contact in order to fold it, the partial lateral tear R being generated at the same time (folding step).

Figure 6:
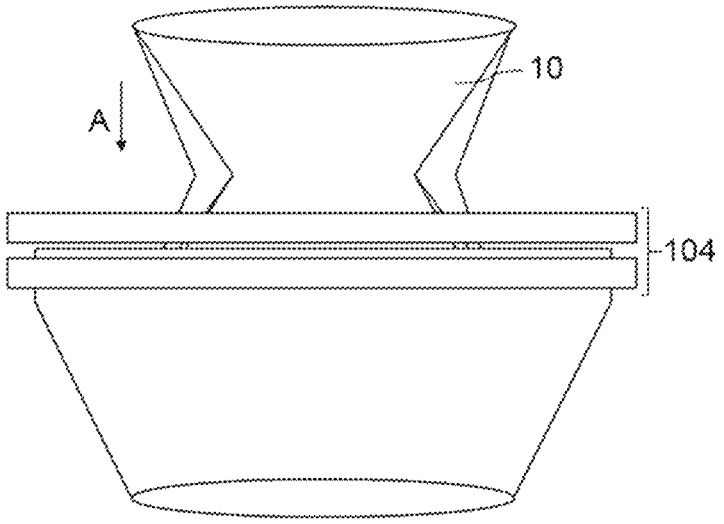
FIG. 6 schematically shows a step in which the tube is sealed and cut in a manner that is transverse to each side of the tear by means of a sealing and cutting device of the machine of FIG. 1, in which the sealing of the end of the package once it recovers its initial shape, and the sealing of the end of the tube with the previously made fold are further depicted.

The tube 10 is sealed and cut transversely (subsequent sealing and cutting step, depicted by way of example in FIG. 6).

A second aspect relates to a packaging machine 100 comprising a driving device 102 for supplying a tube 10 of film material generated from a continuous film in a forward movement direction A, an actuation device 103 for acting by contact on said tube 10, in a manner that is transverse to the forward movement direction A, to laterally fold part of the tube 10 inwardly in a folding direction T transverse to the forward movement direction A, a sealing and cutting device 104 for sealing and cutting the tube 10 in a manner that is transverse to the forward movement direction A, a tube 10 closed at one end being obtained upstream in the forward movement direction and a package E closed at both ends and separated from the tube 10 being obtained downstream in said forward movement direction A. The product to be packaged has previously been introduced into the tube 10, but that step is not described in detail since it can be done in a conventional manner, for example. The packaging machine 100 further comprises a control device for controlling the elements involved in generating the packages E that is not depicted in the drawings.

According to one embodiment of the packaging machine 100 shown in FIG. 1, the packaging machine 100 is configured for generating the tube 10, and further comprises a forming tube 101 configured for receiving a film in a feed direction 100A and forming it into a tubular shape. The packaging machine 100 further comprises a sealing device 108 sealing the film longitudinally, in the forward movement direction A, once it has taken on the tubular shape and as the driving device 102 causes the forward movement of the tubular-shaped film in said forward movement direction A, the tube 10 thus being formed. The forming tube 101 is hollow, and the product to be packaged is introduced into this hollow space.

The packaging machine 100 further comprises a holding device 106 for holding the tube 10 in a manner that is transverse to the forward movement direction A, shown in further detail in FIGS. 7 to 11. In the preferred embodiment, the holding device 106 comprises two opposite transverse elements which move closer to one another for holding the tube 10 between them.

The actuation device 103 of the packaging machine 100 is suitable and configured for generating, by acting on the tube 10, and in addition to the folding, a partial lateral tear R (explained above for the method) in a part of the tube 10 that is located between the actuation device 103 and the holding device 106, extending transverse to the forward movement direction A.

The control device of the packaging machine 100 is at least configured:

for causing the holding device 106 to hold the tube 10 in a manner that is transverse to the forward movement direction A, at least during the action of the actuation device 103 on said tube 10, and for causing the sealing and cutting device 104 to act on the tube 10 for obtaining the package E, once the tube 10 has been acted on with the actuation device 103 and the tear R has been generated, the folded part being located in the package E and/or in the closed tube 10.

As discussed above, as a result of the holding exerted by the holding device 106 during the generation of the tear R, the part of the tube 10 between the tear R and the holding device 106 is caused to return to its previous shape before the action of the actuation device 103, if it had been affected by said action, or to maintain its shape without being affected by said action, there being, in any case, a smooth, fold-less part of the tube 10 between said tear R and the part that is held by the holding device 106 which allows a clean subsequent sealing in said part of the tube 10.

The tube 10 comprises a line of weakness 5, and the action of the actuation device 103 causes the part of the tube 10 comprising the line of weakness 5 to tear or break, the partial lateral tear R thus being generated, the control device being configured for causing the sealing and cutting device 104 to act on the tube 10 when the part of the tube 10 comprising said partial lateral tear R is opposite said sealing and cutting device 104.

In some embodiments of the packaging machine 100, the film from which the tube 10 is formed comprises a previously made line of weakness, and the tube 10 of film material is acted on in the forward movement direction A on one side of said line of weakness to cause the partial lateral tear R with said action aided by said line of weakness, the actuation device 103 not requiring a specific configuration for generating the tear R. The line of weakness can be a transverse discontinuous linear cut, for example, and with the action the discontinuous linear cut becomes a continuous linear cut.

In some embodiments of the packaging machine 100, as in the case of the preferred embodiment, the packaging machine 100 comprises a cutting tool 104*a* configured for generating at least one line of weakness 5 transverse to the forward movement direction A, instead of the film from which the tube 10 is formed comprising a previously made line of weakness. Once said line of weakness 5 is generated, the control device causes the actuation device 103 to act on the tube 10 of film material, on one side of said line of weakness 5 in the forward movement direction A, to cause the partial lateral tear R aided by said line of weakness 5. The line of weakness 5 can be a transverse discontinuous linear cut, for example, and with the action the discontinuous linear cut becomes a continuous linear cut. In said embodiment, the line of weakness 5 is generated in the already formed tube 10.

Figure 7:
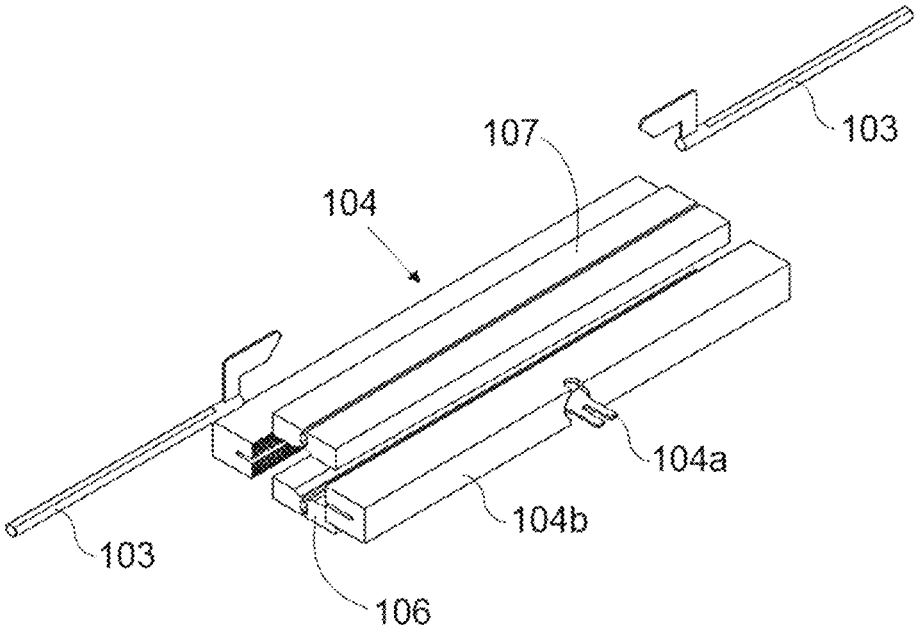
FIG. 7 depicts the position of the holding devices, of the actuation device and of the cutting and sealing device of the packaging machine of FIG. 1, in the situation shown in FIG. 2, the tube not being depicted.
Figure 8:
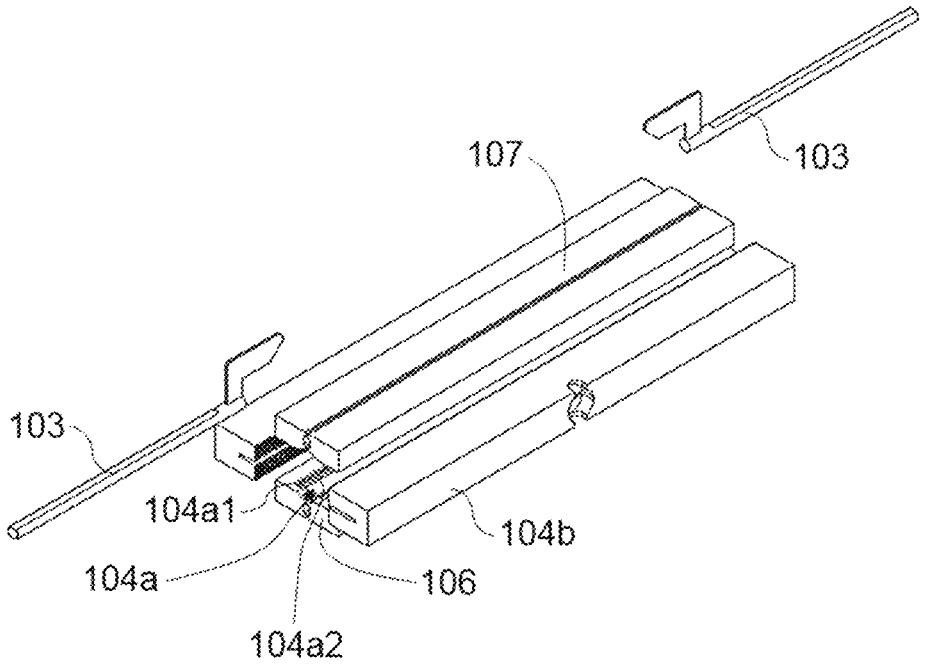
FIG. 8 depicts the position of the cutting and sealing device, of the actuation device, of the holding devices and of the cutting tool of the packaging machine of FIG. 1, during the generation of a line of weakness in the tube, in the situation shown in FIG. 3, said tube not being depicted.
Figure 9:
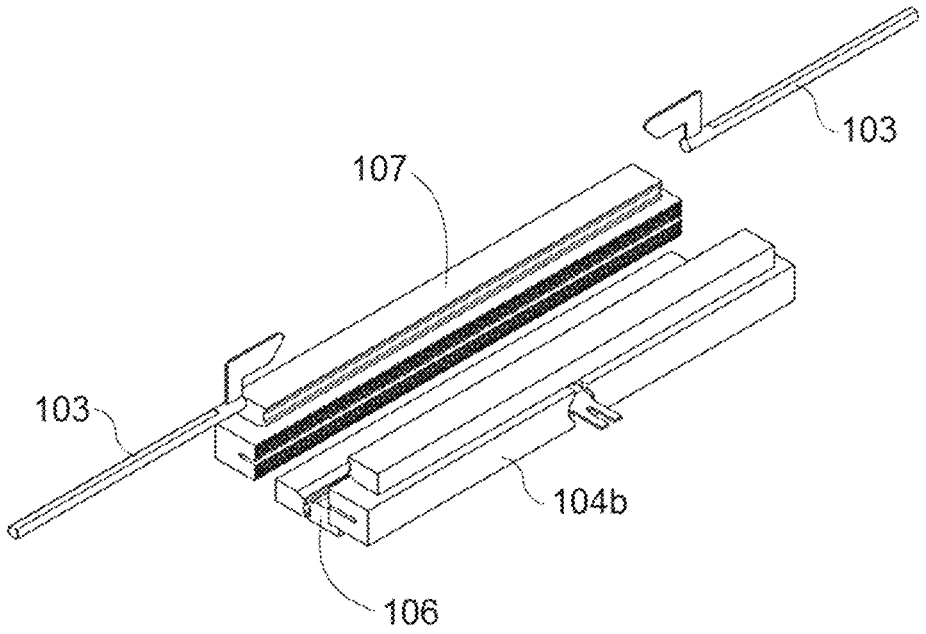
FIG. 9 depicts the position of the cutting and sealing device, of the actuation device, of the holding devices and of the cutting tool of the packaging machine of FIG. 1, once the line of weakness is generated and before the action of the actuation device of said packaging machine, in the situation shown in FIG. 4, the tube not being depicted.

In the embodiments of the packaging machine 100 in which said packaging machine 100 comprises a cutting tool 104*a* configured for generating at least one line of weakness 5, the packaging machine 100 further comprises an additional holding device 107 suitable for transversely holding the tube 10 in a part of said tube 10 separated a given distance in the forward movement direction A from the part of said tube 10 that is held by the holding device 106. In the preferred embodiment, the holding devices 106 and 107 are arranged one on each side of the sealing and cutting device 104, and the additional holding device 107 comprises two elements, like the holding device 106 does. The control device is configured for causing the cutting tool 104*a* to generate the line of weakness 5 while both holding devices 106 and 107 keep said parts of the tube 10 held, and in the part of the tube 10 that is located between both held parts of the tube 10, assuring that the line of weakness 5 is generated correctly. In particular, the control device first causes both holding devices 106 and 107 to hold the tube 10, as depicted in FIG. 7 which shows that the two elements of each holding device 106 and 107 are in the position of trapping the tube 10 between them (situation also depicted in FIG. 2), and by maintaining said fixing, it causes the action of the cutting tool 104*a* for generating the line of weakness (see FIGS. 3 and 8).

According to one embodiment, the control device is configured for causing, once the line of weakness 5 is generated, the additional holding device 107 to release the part of the tube 10 that it previously held, and for causing the actuation device 103 to act on said released part of the tube 10 once it is released.

According to one embodiment, the sealing and cutting device 104 comprises the cutting tool 104*a* in charge of generating the line of weakness 5, said cutting tool 104*a* further being configured for making the transverse cut in the tube 10. The cutting tool 104*a* therefore comprises a first cutting profile 104*a*1 configured for generating the line of weakness 5 and a second cutting profile 104*a*2 configured for making the transverse cut of the tube 10 like a saw, and the control device is configured for moving the cutting tool 104*a* to a first position in which the first cutting profile 104*a*1 of said cutting tool 104*a* contacts the tube 10, and to a second position in which the second cutting profile 104*a*2 of said cutting tool 104*a* contacts the tube 10.

Figure 10:
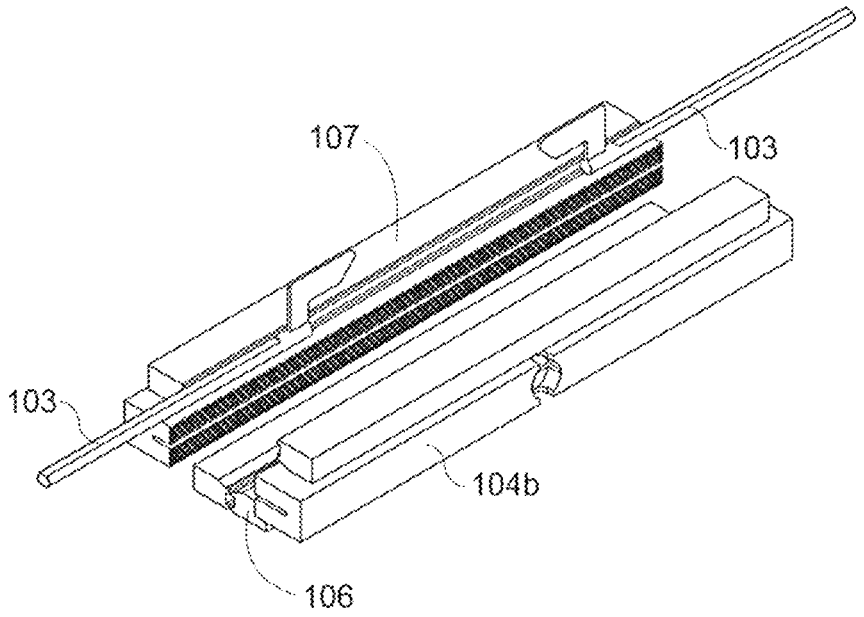
FIG. 10 depicts the position of the cutting and sealing device, of the actuation device, of the holding devices and of the cutting tool of the packaging machine of FIG. 1, during the action of the actuation device of said packaging machine on the tube, in the situation shown in FIG. 5, said tube not being depicted.
Figure 11:
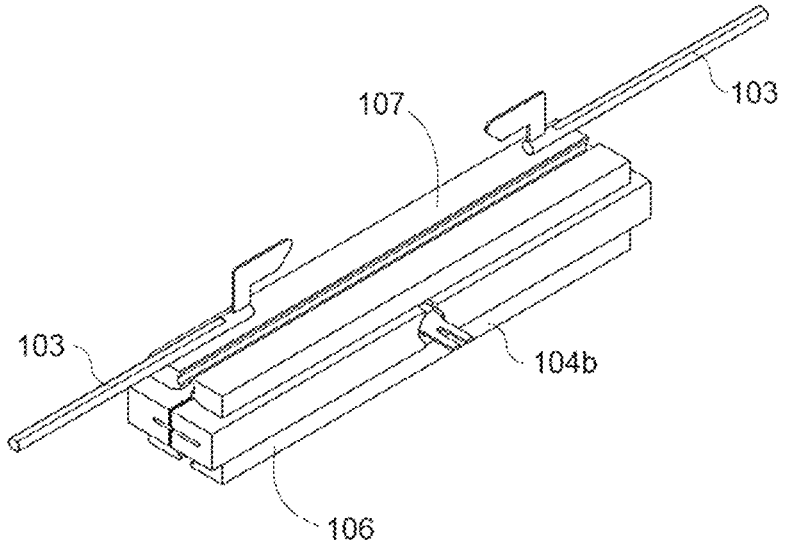
FIG. 11 depicts the position of the cutting and sealing device, of the actuation device, of the holding devices and of the cutting tool of the packaging machine of FIG. 1, during sealing and cutting of the tube, in the situation shown in FIG. 6, said tube not being depicted.

According to one embodiment, once the line of weakness 5 is generated the control device causes the additional holding device 107 to release the part of the tube 10 that kept it held (see FIGS. 4 and 9), and, in that situation, it causes the action of the actuation device 103 (see FIGS. 5 and 10). The sealing and cutting device 104 then causes the sealing of the tube 10 on both sides of the tear R in the forward movement direction A, depicted in FIG. 11, and the transverse cut of the tube 10 preferably at the height of the tear R. In the preferred embodiment, the sealing and cutting device 104 comprises a sealing tool 104*b* generating a first seal on one side of the tear R in the forward movement direction A and a second seal on the other side of said tear R, the transverse cut being made between both seals. In said preferred embodiment, the cutting tool 104*a* is attached to the sealing tool 104*b* with freedom of orthogonal movement with respect to the forward movement direction A (towards the tube 10 and away from the tube 10).

In another alternative embodiment, the packaging machine 100 comprises an actuation device 103 that is configured for acting by contact simultaneously on three parts of the tube 10: two opposite parts and another part on the opposite side of the sealing and cutting device 104, spaced from one of the two aforementioned parts in the forward movement direction A. In this case, the packaging machine 100 is configured for generating a single line of weakness 5 close to and on the side of one of the parts acted on in the forward movement direction A, and the holding device 106 is configured for not covering the entire transverse width of the tube 10, but rather only holding the side comprising the line of weakness 5 and on which the actuation device 103 acts in a single area of contact, resulting in a package E with three folds P1, P2 and P3, such as the one shown by way of example in FIG. 12C.

In any of these cases, the packaging machine 100 can comprise additional elements for incorporating easy-open or reclosable elements, such as a zipper-type element Z in the tube 10, for example, resulting in a package E with this type of closure at one of its ends as shown by way of example in FIG. 12B.

The packaging machine 100 is suitable for generating the packages E that have been discussed in relation to the method, at least the actuation device 103 and the holding device 106 therefore being made suitable or configured accordingly in each case.

The following clauses disclose additional embodiments.

Clause 1: A packaging method for a packaging machine, in which a tube (10) of film material generated from a continuous film is supplied in a forward movement direction (A), and comprising a folding step in which said tube (10) is acted on by contact, in a manner that is transverse to the forward movement direction (A), to laterally fold part of the tube (10) inwardly in a folding direction (T) transverse to the forward movement direction (A), and a sealing and cutting step in which a tube (10) closed at one end is obtained upstream in the forward movement direction (A), and a package (E) closed at both ends and separated from the tube (10) is obtained downstream in said forward movement direction (A), at least during the folding step the tube (10) is held in a manner that is transverse to the forward movement direction (A), and during the folding of the tube (10) a partial lateral tear is generated in the folding direction (T) between the part of the tube (10) that is contacted in order to be folded and the held part of the tube (10), the tube (10) being sealed on both sides of the partial lateral tear with respect to the forward movement direction (A) and said tube (10) being cut at the height of the partial lateral tear during the sealing and cutting step, the folded part being located in the package (E) and/or in the closed tube (10).

Clause 2: The packaging method according to clause 1, wherein the partial lateral tear is made along a line of weakness (5) comprised in the tube (10), part of the tube (10) close to said line of weakness (5), and on one side of said line of weakness (5) with respect to the forward movement direction (A), being acted on by contact in the folding step.

Clause 3: The packaging method according to clause 2, comprising a preparation step prior to the folding step in which the line of weakness (5) is generated transverse to the forward movement direction (A) in the tube (10), or in the film from which the tube (10) is generated.

Clause 4: The packaging method according to clause 3, wherein the line of weakness (5) is generated in the tube (10), and the tube (10) is held, additionally and transverse to the forward movement direction (A) at least during the preparation step, at a given separation distance in the forward movement direction (A) with respect to the first holding, the line of weakness (5) being generated between said two held parts of the tube (10) and while both holdings are maintained.

Clause 5: The packaging method according to clause 4, wherein once the line of weakness (5) is generated, the part of the tube (10) held by the additional holding is released, said released part of the tube (10) being the part which is acted on by contact to fold it inwardly in the folding step once it has been released.

Clause 6: The packaging method according to any of clauses 2 to 5, wherein the line of weakness (5) is a transverse discontinuous linear cut, and it is arranged such that it is located on one side of the part of the tube (10) acted on by contact in the folding step, with respect to the forward movement direction (A).

Clause 7: The packaging method according to any of clauses 2 to 6, wherein in the folding step, said tube (10) is acted on simultaneously by contact, in a manner that is transverse to the forward movement direction (A), in at least two opposite parts of the tube (10), a line of weakness (5) being generated for each action in the preparation step.

Clause 8: The packaging method according to any of clauses 2 to 7, wherein the line of weakness (5) and the transverse cut of the tube (10) are generated by means of one and the same cutting device (104*a*), said device being arranged in a first position for generating the line of weakness (5) and in a second position for generating the transverse cut of the tube (10).

Clause 9: The packaging machine comprising a driving device (102) for supplying a tube (10) of film material in a forward movement direction (A), an actuation device (103) for acting by contact on said tube (10), in a manner that is transverse to the forward movement direction (A), to laterally fold part of the tube (10) inwardly in a folding direction (T) transverse to the forward movement direction (A), a sealing and cutting device (104) for sealing and cutting the tube (10) in a manner that is transverse to the forward movement direction (A), a tube (10) closed at one end being obtained upstream in the forward movement direction (A), and a package (E) closed at both ends and separated from the tube (10) being obtained downstream in said forward movement direction (A), and a control device, the packaging machine (100) further comprises a holding device (106) for holding the tube (10) in a manner that is transverse to the forward movement direction (A), the actuation device (103) being suitable and configured for generating, by acting on the tube (10), in addition to folding, a tear in a part of the tube (10) that is located between the actuation device (2) and the holding device (106), extending transverse to the forward movement direction (A), the control device being configured at least for causing the holding device (106) to hold the tube (10) in a manner that is transverse to the forward movement direction (A), at least during the action of the actuation device (103) on said tube (10), and for causing the sealing and cutting device (104) to act on the tube (10) for obtaining the package (E) once the tube (10) has been acted on with the actuation device (103) and the tear has been generated, the folded part being located in the package (E) and/or in the closed tube (10).

Clause 10: The packaging machine according to clause 9, wherein the tube (10) comprises a line of weakness (5), the action of the actuation device (103) causing the part of the tube (10) comprising the line of weakness (5) to tear or break, the partial lateral tear being thus generated, the control device being configured for causing the sealing and cutting device (104) to act on the tube (10) when the part of the tube (10) comprising said partial lateral tear is opposite said sealing and cutting device (104).

Clause 11: The packaging machine according to clause 10, comprising a cutting tool (104*a*) configured for generating the line of weakness (5) transverse to the forward movement direction (A) in the tube (10), or in the film from which the tube (10) is generated, the control device being configured for causing the actuation device (103) to act laterally on the tube (10) once said line of weakness (5) is generated and on a side of the tube (10) close to and on one side of said line of weakness (5) with respect to said forward movement direction (A), such that the tear is generated by means of tearing the tube (10) along said line of weakness (5).

Clause 12: The packaging machine according to clause 11, comprising an additional holding device (107) suitable for transversely holding the tube (10) in a part of said tube (10) separated a given distance in the forward movement direction (A) from the part of said tube (10) that is held by the holding device (106), the control device being configured for causing the cutting tool (104*a*) to generate the line of weakness (5) while both holding devices (106, 107) keep said parts of the tube (10) held, and in the part of the tube (10) located between both held parts of the tube (10).

Clause 13: The packaging machine according to clause 12, wherein the control device is configured for causing the additional holding device (107) to release the part of the tube (10) that it previously held once the line of weakness (5) is generated, and for causing the actuation device (103) to act on said released part of the tube (10) once it is released.

Clause 14: The packaging machine according to any of clauses 10 to 13, wherein the sealing and cutting device (104) comprises the cutting tool (104*a*) in charge of generating the line of weakness (5), said cutting tool (104*a*) further being configured to make the transverse cut in the tube (10), the cutting tool (104*a*) therefore comprising a first cutting profile (104*a*1) configured for generating the line of weakness (5) and a second cutting profile (104*a*2) configured for making the transverse cut in the tube (10), the control device being configured for moving the cutting tool (104*a*) to a first position in which the first cutting profile (104*a*1) of said cutting tool (104*a*) contacts the tube (10), and to a second position in which the second cutting profile (104*a*2) of said cutting tool (104*a*) contacts the tube (10).

What is claimed is:

1. A packaging machine for making flat bottom packages, the packaging machine comprising:

a driving device for supplying a tube of a film material in a forward movement direction;

an actuation device configured to contact the tube in a manner that is transverse to the forward movement direction to laterally fold a first part of the tube inwardly in a folding direction transverse to the forward movement direction to produce a fold in the tube;

a first holding device configured to hold a second part of the tube in a manner that is transverse to the forward movement direction, the tube including a line of weakness and the actuation device being configured to act on the line of weakness to produce a partial lateral tear in a part of the tube that is located between the actuation device and the first holding device, the partial lateral tear extending transverse to the forward movement direction and in a manner that does not fully separate the tube into two parts; and a sealing and cutting device configured to produce first and second transverse seals and a transverse cut located between the first and second seals to produce, upstream the transverse cut, a closed end tube that includes the fold, and to produce, downstream the transverse cut a sealed package;

a cutting tool configured to generate the line of weakness in the tube transverse to the forward movement direction; and a control device that is configured to cause the actuation device to contact the tube in the manner that is transverse to the forward movement direction to produce in the tube the partial lateral tear after the line of weakness is generated, the control device being configured to cause the sealing and cutting device to produce the first and second transverse seals and transverse cut when the line of weakness is located facing the sealing and cutting device.

2. The packaging machine according to claim 1, further comprising a second holding device configured to hold the first part of the tube in a manner that is transverse to the forward movement direction, the first part being spaced a distance away from the second part in the forward movement direction, wherein the control device is configured to cause the cutting tool to generate the line of weakness while both the first and second holding devices respectively hold the second and first parts of the tube.

3. The packaging machine according to claim 2, wherein the control device is configured to cause the second holding device to release holding the first part of the tube after the line of weakness is generated, and to subsequently cause the actuation device to act on the first part of the tube to produce the fold.

4. The packaging machine according to claim 1, wherein the sealing and cutting device comprises the cutting tool that generates the line of weakness when in a first position, the cutting tool further being configured to make the transverse cut in the tube when in a second position, the cutting tool comprising a first cutting profile when in the first position that is configured to generate the line of weakness and a second cutting profile when in the second position that is configured to produce the transverse cut in the tube, the control device being configured to move the cutting tool between the first and second position.

* * * * *